US007201567B2

(12) United States Patent
Wiertz et al.

(10) Patent No.: US 7,201,567 B2
(45) Date of Patent: Apr. 10, 2007

(54) PLURAL COMPRESSORS

(75) Inventors: Guido Wiertz, Suzhou (CN); Robert Iserentante, Spa (BE); Didier Doutrepont, Theux (BE); Johann Dobrescu, Stolberg (DE); Francis Pirenne, Welkenraedt (BE); Gary Anderson, Sidney, OH (US); Philippe Ernst, Henri-Chapelle (BE); Clyde Verhoff, Fort Loramie, OH (US); Pierre Poysat, Jalhay (BE)

(73) Assignee: Emerson Climate Technologies, Inc., Sidney, OH (US)

( * ) Notice: Subject to any disclaimer, the term of this patent is extended or adjusted under 35 U.S.C. 154(b) by 381 days.

(21) Appl. No.: 10/600,106

(22) Filed: Jun. 20, 2003

(65) Prior Publication Data

US 2004/0258542 A1 Dec. 23, 2004

(51) Int. Cl.

| | |
|---|---|
| ***F04B 17/03*** | (2006.01) |
| ***F01C 1/02*** | (2006.01) |
| ***F01C 1/063*** | (2006.01) |

(52) U.S. Cl. ..... 417/410.5; 418/55.1; 418/60

(58) Field of Classification Search ..... 417/350, 417/410.4, 410.5; 418/55.1, 60

See application file for complete search history.

(56) References Cited

U.S. PATENT DOCUMENTS

| | | | | |
|---|---|---|---|---|
| 5,123,818 | A * | 6/1992 | Gormley et al. | 417/410.5 |
| 5,211,031 | A * | 5/1993 | Murayama et al. | 62/498 |
| 6,672,846 | B2 * | 1/2004 | Rajendran et al. | 417/410.5 |
| 6,988,876 | B2 * | 1/2006 | Ke et al. | 418/60 |

* cited by examiner

*Primary Examiner*—Charles G. Freay
(74) *Attorney, Agent, or Firm*—Harness, Dickey & Pierce, P.L.C.

(57) ABSTRACT

A compressor system includes a pair of compressors located in a common shell. A common drive shaft drives both compressors and the drive shaft is powered by a single motor. One or both of the compressors can be equipped with a pulse width modulated capacity control system and a vapor injection system. When one compressor is equipped with these systems, the capacity can be varied between 50% and 110%. When both compressors are equipped with these systems, the capacity can be varied between 0% and 120%.

58 Claims, 10 Drawing Sheets

PLURAL COMPRESSORS

FIELD OF THE INVENTION

The present invention relates to plural compressors disposed within a single shell. More particularly, the present invention relates to plural compressors disposed within a single shell where two compressors, located at opposite ends of a motor, are both driven by the motor.

BACKGROUND AND SUMMARY OF THE INVENTION

Due to energy costs and conservation, there is a demand for refrigerant motor-compressor systems which have an output which can be varied in accordance with demand. To satisfy this demand, a large number of systems have been developed. One such system involves the unloading of one or more cylinders in a multi-cylinder compressor or the varying of re-expansion volume for the purpose of varying the output of the compressor system. These variable capacity systems tend to be relatively complex and the efficiency of the compressor in an unloaded stated is not optimum. Variable speed compressors have also been used, but these variable speed compressors require expensive controls. The efficiency of the speed control, as well as the efficiency of the motor-compressor, present problems at least when the system is operating in a reduced capacity condition.

Compressor systems have also been developed which, in place of a single compressor large enough to carry the maximum load demand, include a plurality of smaller motor compressors having a combined output equal to the required maximum load demand. These multi-compressor systems include means for controlling the total system in such a manner as to selectively activate and deactivate each of the plurality of motor compressors independently when the load demand varies so that the compressor system output meets the required load demand. These multi-compressor systems have good efficiency but they require complex piping and plumbing systems, including means for dealing with lubricating oil management in order to ensure that all of the lubricating oil remains equally distributed between each of the individual compressors.

Additional designs for the multi-compressor systems have included the incorporation of a plurality of standard motor compressor units in a common single compressor shell. The common shell maximizes the compactness of the system and it provides a common oil sump for equal oil distribution, a common suction gas inlet and a common discharge gas outlet. These single shell multi-compressor systems have proved to be acceptable in the market place, but they tend to be relatively large and the means for controlling the total system is still somewhat complex.

The continued development of multi-compressor systems has been directed towards reducing the overall costs and the overall size of the system as well as simplifying the control systems which determine the compressor system's output in relation to the system demand.

The present invention provides the art with a multi-compressor compression system where a single compressor is located at opposing sides of a single drive shaft. A single motor rotor is press fit to the central portion of the drive shaft and the single motor rotor is disposed within a single motor stator. Thus, both compressors are powered by the same rotor and stator of a single motor. The control of the output of the multi-compressor system is accomplished by a variable speed motor or by a pulsed width modulation (PWM) capacity control system incorporated into one or both of the opposing compressors. When incorporating a variable speed motor for capacity control, the capacity can be varied from 0% to 100%. When incorporating the PWM capacity control system into one of the compressors, the capacity can be varied from 50% and 100%. When incorporating the PWM capacity control system into both compressors, the capacity can be varied from 0% to 100%. The capacity of one or both of the compressors can be increased to approximately 120% of capacity using a vapor injection system to further increase the range of the dual compressor system if desired. More than one of these dual-compressor/single motor systems can be incorporated into a single shell if desired.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
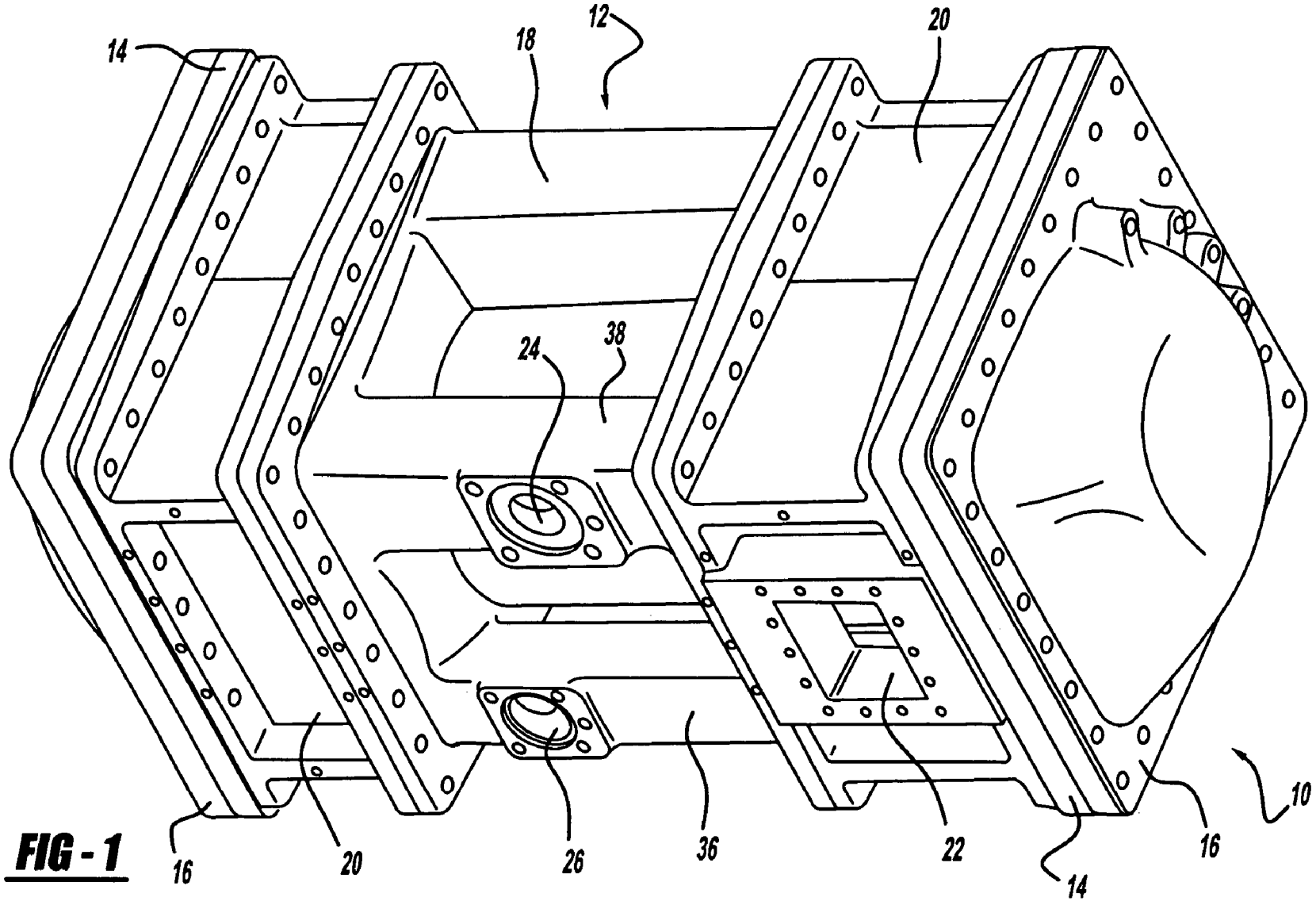
FIG. 1 is a perspective view of the motor compression system in accordance with the present invention.

There is shown in FIG. 1 a multi-compressor compression system in accordance with the present invention which is designated generally by the reference numeral 10. Compression system 10 comprises a multi-piece hermetic shell assembly 12 having bolted at each end thereof a partition plate assembly 14 and an end cap 16.

Shell assembly 12 comprises a central shell 18 and a pair of intermediate shells 20, with each intermediate shell 20 being located at opposite ends of central shell 18. Each intermediate shell 20 is bolted to central shell 18 as shown in FIG. 1. One intermediate shell 20 defines an electrical connection access 22 for providing electrical and diagnostic connection to the motor within shell assembly 12. Central shell 18 is provided with a single suction inlet fitting 24 and a single discharge fitting 26.

Each partition plate assembly 14 comprises an outer plate 28 and a transversely extending separation plate 30. Each outer plate 28 is bolted between a respective intermediate shell 20 of shell assembly 12 and a respective end cap 16. Each separation plate 30 sealingly engages a respective outer plate 28 to define a discharge pressure chamber 32 located at opposite ends of compression system 10 and a single suction pressure chamber 34 located between the two partition plate assemblies 14. Discharge pressure chamber 32 is in communication with discharge fitting 26 through a conduit 36 which is spaced from the main body of central shell 18 as illustrated in FIG. 1. Similarly, suction pressure chamber 34 is in communication with suction inlet fitting 24 through a conduit 38 which is spaced from the main body of central shell 18 as illustrated in FIG. 1. The separation of conduits 36 and 38 from the main body of central shell 18 limits the heat transfer between each of the conduits and the main body of central shell 18. A discharge valve (not shown) can be located anywhere within conduit 36, if desired.

A compressor mounting frame 40 is formed by end caps 16, partition plate assemblies 14 and shell assembly 12.

Figure 2:
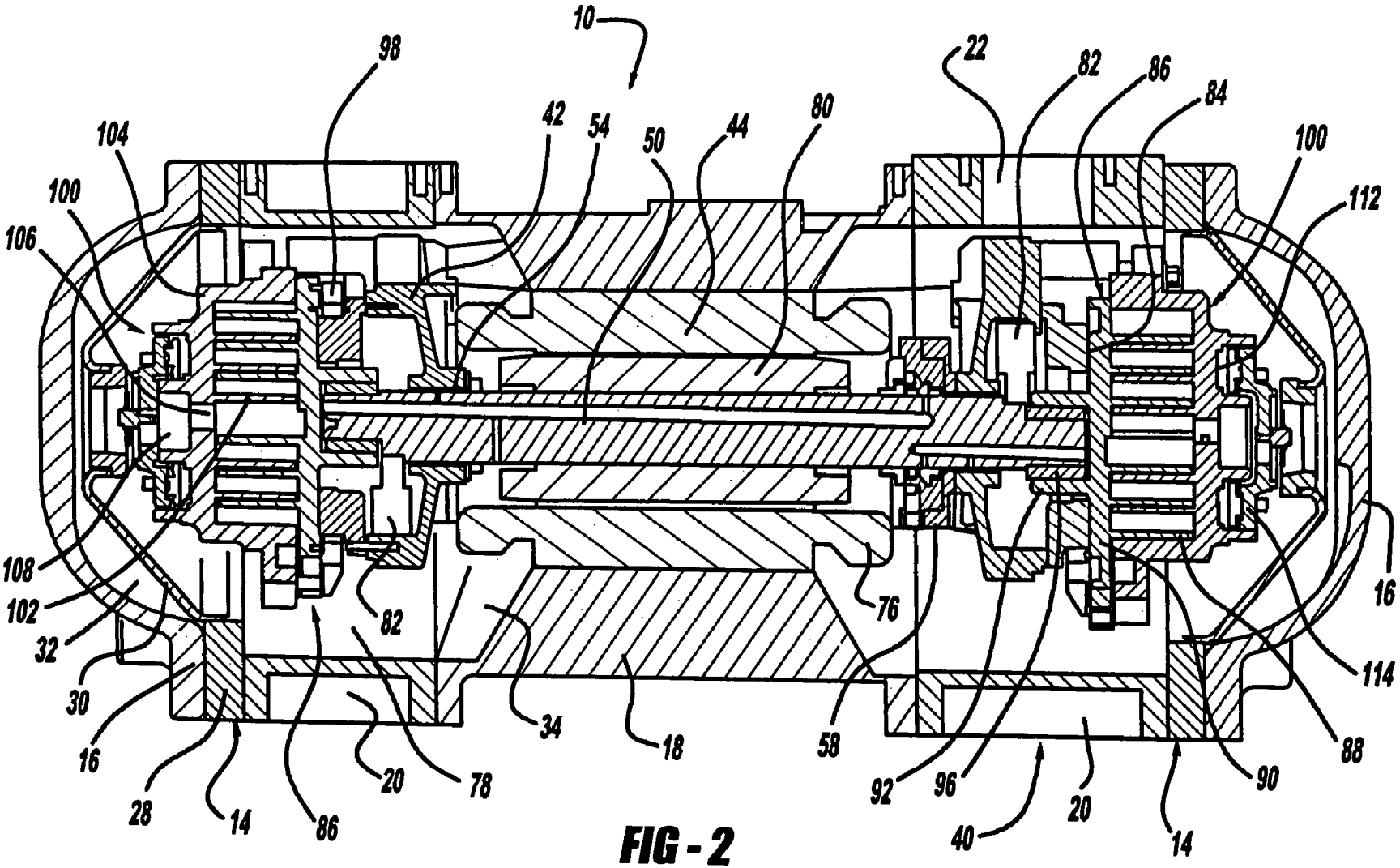
FIG. 2 is a vertical cross-sectional view through the motor compressor systems illustrated in FIG. 1.
Figure 3:
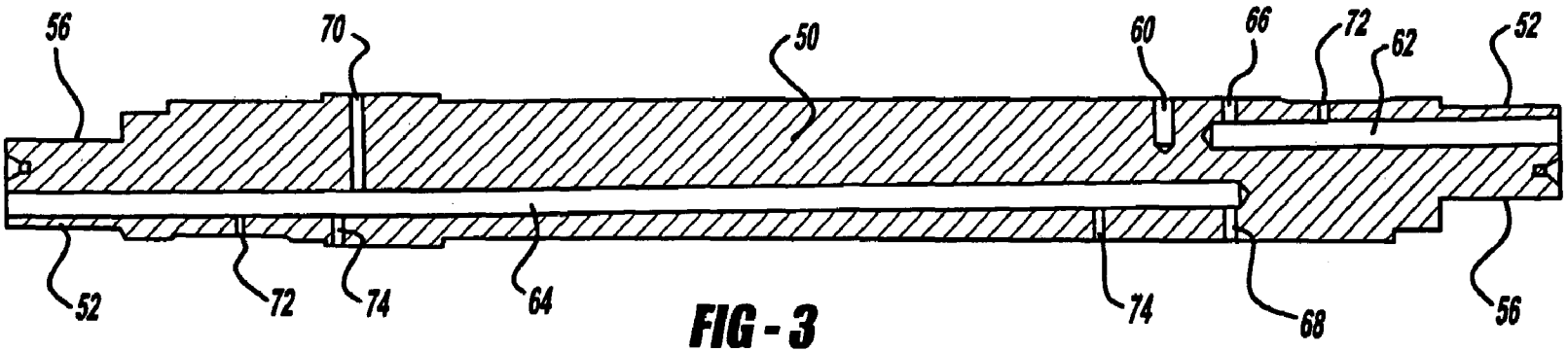
FIG. 3 is a cross-sectional view of the drive shaft illustrated in FIG. 2.

Major elements of compression system 10 that are affixed to shell assembly 12 include a pair of two-piece main bearing assemblies 42 and a motor stator 44. A single drive shaft or crank shaft 50 having a pair of eccentric crank pins 52 at opposite ends thereof is rotatably journaled in a pair of bearings 54, each secured within a respective main bearing assembly 42. Each crank pin 52 has a driving flat 56 on one surface. Driving flats 56 are out of rotational phase with one another by 180°, as illustrated in FIGS. 2 and 3, in order to reduce discharge pulse and minimize drive shaft bending in compression system 10.

An oil pump 58 is secured to one of the main bearing assemblies 42, and the impeller of oil pump 58 is driven by crank shaft 50 using a drive pin hole 60. Crank shaft 50 has an axially extending bore 62 extending from one end and an axially extending bore 64 extending from the opposite end. Axial bore 62 is in communication with a radial bore 66 to receive lubricating oil from oil pump 58 and provide the lubricating oil to one side of compression system 10. Axial bore 64 is in communication with a radial bore 68 to receive lubricating oil from oil pump 58 and provide the lubricating oil to the opposite side of compression system 10. A radial vent hole 70 is in communication with axial bore 64. In addition, a pair of radial bores 72, one extending from axial bore 62 and one extending from axial bore 64, provide lubricating oil to main bearing assemblies 42. A second set of radial bores 74 extending from axial bore 64 provide lubricating oil to windings 76 passing through motor stator 44 for cooling purposes. The lower portion of shell assembly 12 defines an oil sump 78 which is filled with lubricating oil to a level slightly below the lower end of motor stator 44. Oil pump 58 draws oil from oil sump 78 and pumps the lubricating oil through the various bores and holes in crank shaft 50 to the components of compression system 10.

Crank shaft 50 is rotatably driven by an electric motor which includes motor stator 44, windings 76 passing through motor stator 44, and a rotor 80 press fit to crank shaft 50. A pair of counterweights 82 are secured to opposite ends of crank shaft 50 adjacent a respective crank pin 52.

The upper surface of each two-piece main bearing assembly 42 is provided with a flat thrust bearing surface 84 on which is disposed a respective orbiting scroll member 86 having the usual spiral vane or wrap 88 extending outwardly from an end plate 90. Projecting outwardly from the lower surface of each end plate 90 of each orbiting scroll member 86 is a cylindrical hub 92 having a journal bearing therein and in which is rotatably disposed a drive bushing 96 having an inner bore in which a respective crank pin 52 is drivingly disposed. Each crank pin 52 has driving flat 56 on one surface which drivingly engages a flat surface formed in a portion of the inner bore of each drive bushing 96 to provide a radially compliant driving arrangement, such as shown in Assignee's U.S. Pat. No. 4,877,382, the disclosure of which is hereby incorporated herein by reference. As detailed earlier, flats 56 are 180° out of phase with one another. A pair of Oldham couplings 98 are also provided, with one being provided between each orbiting scroll member 86 and each two-piece main bearing assembly 42. Each Oldham coupling 98 is keyed to a respective orbiting scroll member 86 and to a respective non-orbiting scroll member 100 to prevent rotation of orbiting scroll members 86. Each Oldham coupling 98 can be keyed to a respective orbiting scroll member 86 and to a respective main bearing assembly 42, if desired.

Each non-orbiting scroll member 100 is also provided with a wrap 102 extending outwardly from an end plate 104 which is positioned in meshing engagement with a respective wrap 88 of a respective orbiting scroll member 86. Each non-orbiting scroll member 100 has a centrally disposed discharge passage 106 which communicates with a centrally located open recess 108 which is, in turn, in fluid communication with a respective discharge pressure chamber 32. An annular recess 112 is also formed in each non-orbiting scroll member 100 within which is disposed a respective floating seal assembly Recesses 108 and 112 and floating seal assemblies 114 cooperate to define axial pressure biasing chambers which receive pressurized fluid being compressed by respective wraps 88 and 102 so as to exert an axial biasing force on a respective non-orbiting scroll member 100 to thereby urge the tips of respective wraps 88 and 102 into sealing engagement with the opposed end plate surfaces of end plates 104 and 90, respectively. Floating seal assemblies 114 are preferably of the type described in greater detail in Assignee's U.S. Pat. No. 5,156,539, the disclosure of which is hereby incorporated herein by reference. Non-orbiting scroll members 100 are designed to be mounted for limited axial movement with respect to two-piece main bearing assembly 42 in a suitable manner, such as disclosed in the aforementioned U.S. Pat. No. 4,877,382 or Assignee's U.S. Pat. No. 5,102,316, the disclosure of which is hereby incorporated herein by reference.

Shell assembly 12 defines suction pressure chamber 34 which receives a gas for compression from suction inlet fitting 24 through conduit 38. The gas within suction pressure chamber 34 is taken in at the radially outer portion of both sets of intermeshed scrolls 86 and 100, is compressed by both sets of wraps 88 and 102, and then discharged into discharge pressure chambers 32 through discharge passage 106 and recesses 108. The compressed gas exits each discharge pressure chamber 32 through conduit 36 and discharge fitting 26.

When it is desired to incorporate a capacity control system into compression system 10, the electric motor can be designed as a variable speed motor. The design for the variable speed motor, which includes motor stator 44, windings 76 and rotor 80, are well known in the art and will not be discussed in detail. By providing variable speed capacity to the electric motor, the capacity of compression system 10 can be varied between 0% and 100%.

Figure 4:
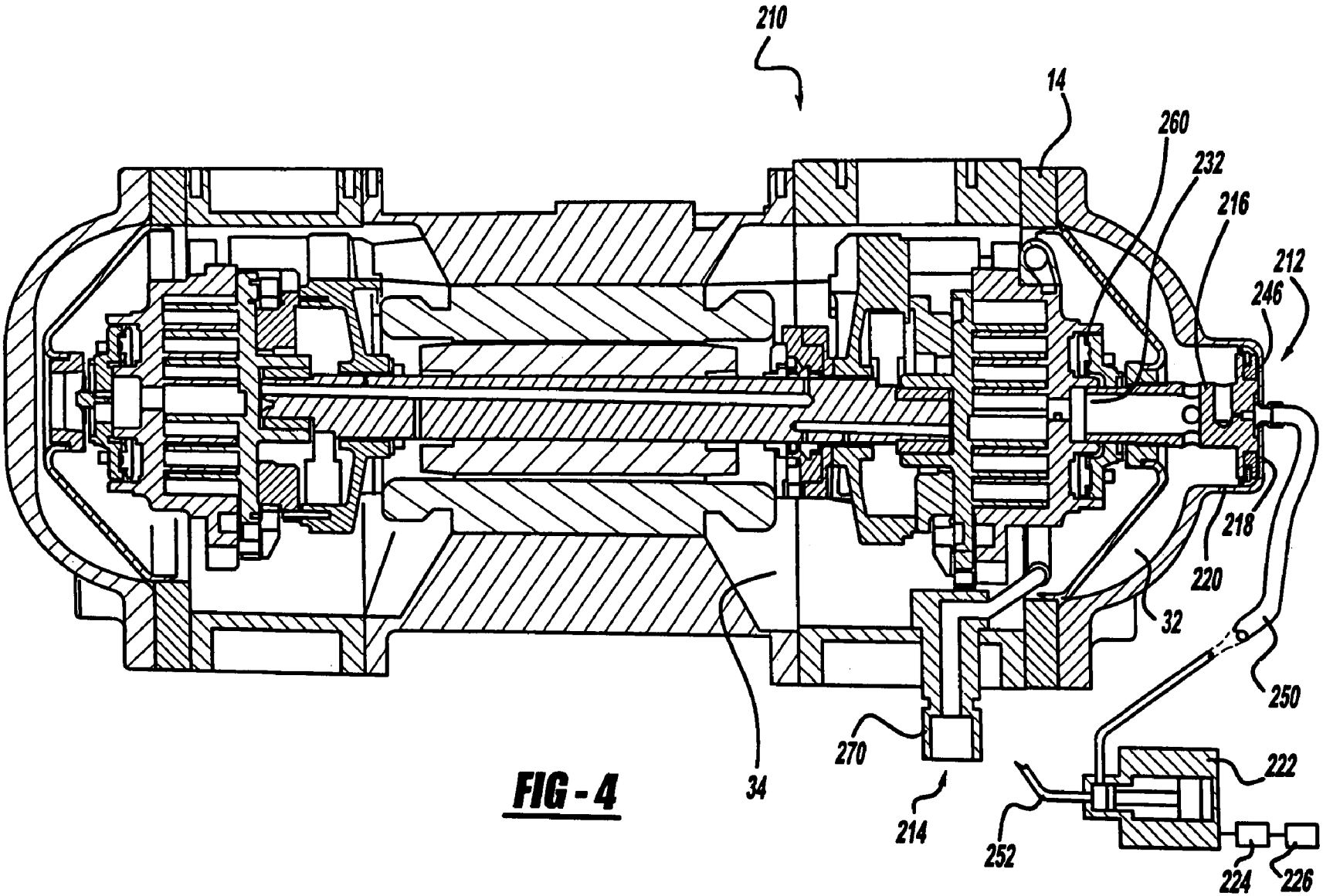
FIG. 4 is a vertical cross-sectional view of the motor compressor system shown in FIG. 2 with one of the two compressors incorporating a pulse width modulation capacity control system and a vapor injection system.

Referring now to FIG. 4, there is shown a compression system which incorporates a unique capacity control system and a vapor injection system in accordance with another embodiment of the present invention. Compression system 210 is the same as compression system 10, except that one pair of scrolls 86 and 100 incorporate a capacity control system 212 and a vapor injection system 214.

Capacity control system 212 includes a discharge fitting 216, a piston 218, a shell fitting 220, a solenoid valve 222, a control module 224, and a sensor array 226 having one or more appropriate sensors. Discharge fitting 216 is threadingly received or otherwise secured within open recess 108, and discharge fitting 216 defines an internal cavity 228 and a plurality of discharge passages 230. A discharge valve 232 is disposed below discharge fitting 216. Thus, pressurized gas overcomes the biasing load of discharge valve 232 to open discharge valve 232 and allow the pressurized gas to flow into cavity 228 through discharge passages 230 and into discharge pressure chamber 32.

Figure 6:
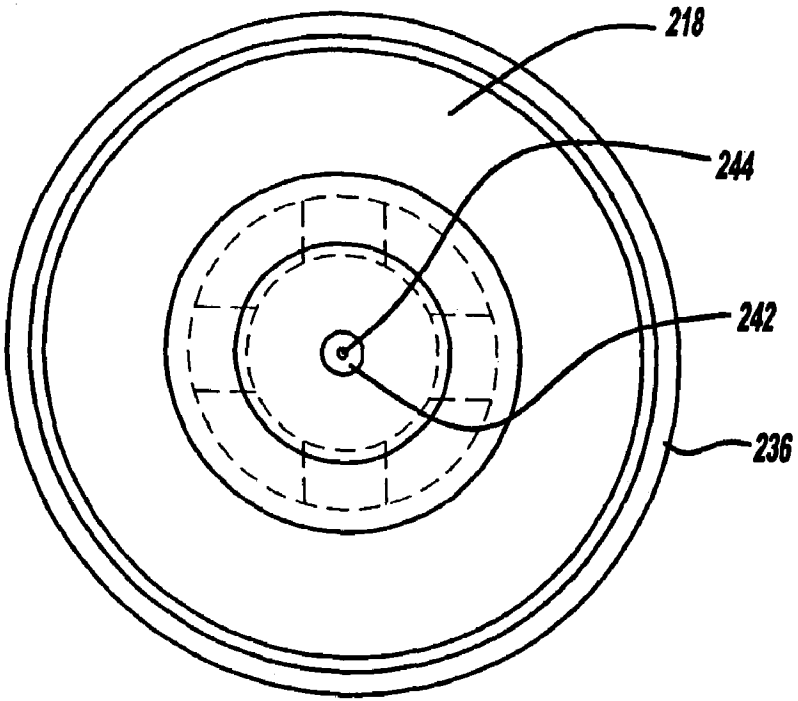
FIG. 6 is a top view of the piston assembly shown in FIG. 5.
Figure 5:
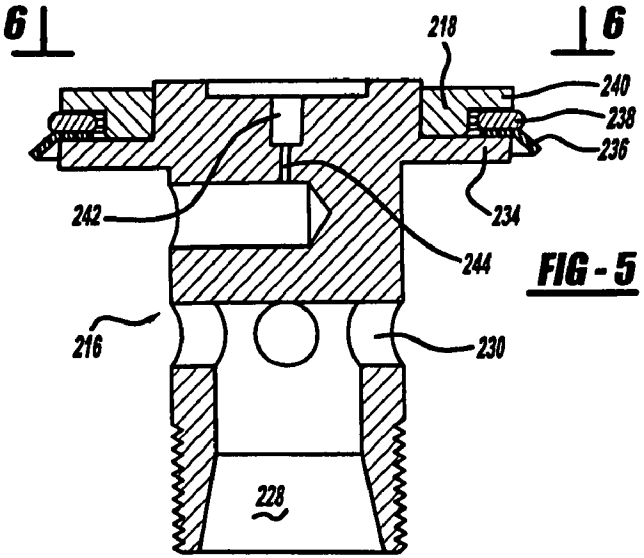
FIG. 5 is an enlarged sectional view of the piston assembly shown in FIG. 4.

Referring now to FIGS. 4, 5 and 6, the assembly of discharge fitting 216 and piston 218 is shown in greater detail. Discharge fitting 216 defines an annular flange 234. Seated against flange 234 is a lip seal 236 and a floating retainer 238. Piston 218 is press fit or otherwise secured to discharge fitting 216, and piston 218 defines an annular flange 240 which sandwiches lip seal 236 and floating retainer 238 between flange 240 and flange 234. Discharge fitting 216 defines a passageway 242 and an orifice 244 which extends through discharge fitting 216 to fluidically connect discharge pressure chamber 32 with a pressure chamber 246 defined by discharge fitting 216, piston 218, lip seal 236, floating retainer 238, and end cap 16. Shell fitting 220 is secured to end cap 16 and slidingly receives the assembly of discharge fitting 216, piston 218, lip seal 236, and floating retainer 238. Shell fitting 220 can be integral with end cap 16, as shown in FIG. 4, or shell fitting 220 can be a separate component attached to end cap 16 by bolts or other means known well in the art. Pressure chamber 246 is fluidically connected to solenoid valve 222 by a tube 250, and with suction pressure chamber 34 through a tube 252. The combination of piston 218, lip seal 236 and floating retainer 238 provides a self-centering sealing system to provide accurate alignment with the internal bore of shell fitting 220. Lip seal 236 and floating retainer 238 include sufficient radial compliance such that any misalignment between the internal bore of open recess 108 within which discharge fitting 216 is secured is accommodated by lip seal 236 and floating retainer 238.

In order to bias non-orbiting scroll member 100 into sealing engagement with orbiting scroll member 86 for normal full load operation, solenoid valve 222 is deactivated (or it is activated) by control module 224 in response to sensor array 226 to block fluid flow between tubes 250 and tube 252. In this position, pressure chamber 246 is in communication with discharge pressure chamber 32 through passageway 242 and orifice 244. The pressurized fluid at discharge pressure within pressure chambers 32 and 246 will act against opposite sides of piston 218 thus allowing for the normal biasing of non-orbiting scroll member 100 towards orbiting scroll member 86 to sealingly engage the axial ends of each scroll member with the respective end plate of the opposite scroll member. The axial sealing of the two scroll members 86 and 100 causes compression system 210 to operate at 100% capacity.

In order to unload compression system 210, solenoid valve 222 will be activated (or it will be deactivated) by control module 224 in response to sensor array 226. When solenoid valve 222 is actuated (or unactuated), suction pressure chamber 34 is in direct communication with pressure chamber 246 through tube 252, solenoid valve 222 and tube 250. With the discharge pressure pressurized fluid released to suction from pressure chamber 246, the pressure difference on opposite sides of piston 218 will move non-orbiting scroll member 100 to the right as shown in FIG. 4 to separate the axial end of the tips of each scroll member with its respective end plate and the higher pressurized pockets will bleed to the lower pressurized pockets and eventually to suction pressure chamber 34. Orifice 244 is incorporated to control the flow of discharge gas between discharge pressure chambers 32 and chamber 246. Thus, when pressure chamber 246 is connected to the suction side of the compressor, the pressure difference on opposite sides of piston 218 will be created. A wave spring 260 is incorporated to maintain the sealing relationship between floating seal assembly 114 and partition plate assembly 14 during modulation of non-orbiting scroll member 100. When a gap is created between the two scroll members 86 and 100, the continued compression of the suction gas will be eliminated. When this unloading occurs, discharge valve 232 will move to its closed position thereby preventing the backflow of high pressurized fluid from discharge pressure chamber 32 or the downstream refrigeration system. When compression of the suction gas is to be resumed, solenoid valve 222 will be deactivated (or it will be activated) to again block fluid flow between tubes 250 and 252 allowing pressure chamber 246 to be pressurized by discharge pressure chamber 32 through passageway 242 and orifice 244.

Control module 224 is in communication with sensor array 226 to provide the required information for control module 224 to determine the degree of unloading required for the particular conditions of the refrigeration system including compression system 210 existing at that time. Based upon this information, control module 224 will operate solenoid valve 222 in a pulsed width modulation mode to alternately place chamber 246 in communication with discharge pressure chamber 32 and suction pressure chamber 34. The frequency with which solenoid valve 222 is operated in the pulsed width modulated mode will determine the percent capacity of operation of one set of scrolls 86 and 100 of compression system 210. As the sensed conditions change, control module 224 will vary the frequency of operation for solenoid valve 222 and thus the relative time periods at which one set of scrolls 86 and 100 of compression system 210 is operated in a loaded and unloaded condition. The varying of the frequency of operation of solenoid valve 222 can cause the operation of one set of scrolls 86 and 100 between fully loaded or 100% capacity and completely unloaded or 0% capacity or at any of an infinite number of settings in between in response to system demands. This has the effect of varying the capacity of compression system 210 between 50% and 100%.

Figure 8:
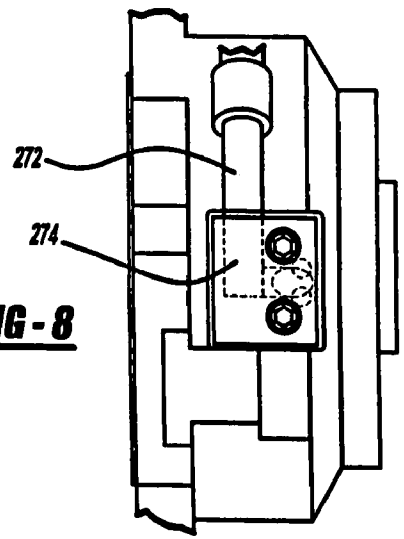
FIG. 8 is a side view of the non-orbiting scroll member of the modulated compressor shown in FIG. 4 illustrating the vapor injection system.
Figure 7:
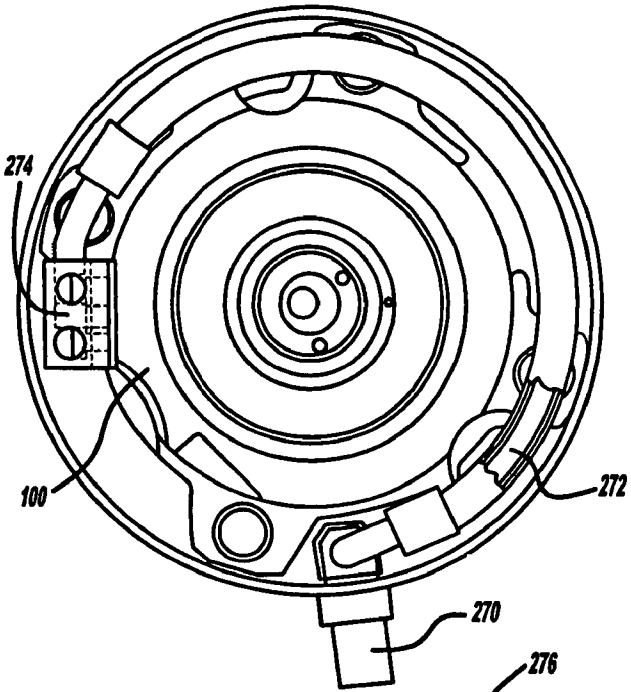
FIG. 7 is an end section view of the modulated compressor shown in FIG. 4 illustrating the vapor injection system.
Figure 9:
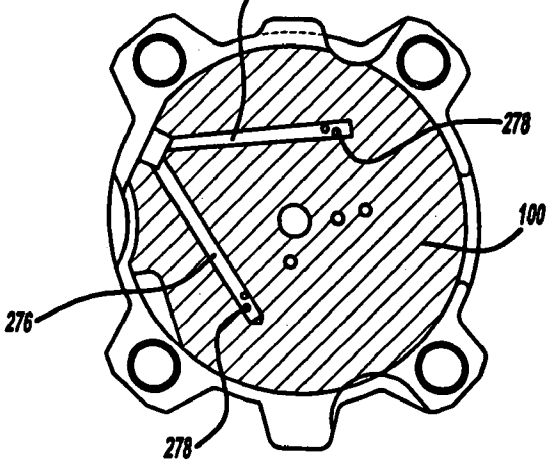
FIG. 9 is a cross-section top view of the non-orbiting scroll of the modulated compressor shown in FIG. 4 illustrating the vapor injection system.

Referring now to FIGS. 7, 8 and 9, vapor injection system 214 for compression system 210 is shown in greater detail. Compression system 210 includes the capability of having vapor injected into the intermediate pressurized moving chambers at a point intermediate suction pressure chamber 34 and discharge pressure chamber 32. A vapor injection fitting 270 extends through shell assembly 12 and is fluidically connected to an injection tube 272 which is in turn fluidically connected to an injection fitting 274 secured to non-orbiting scroll member 100. Non-orbiting scroll member 100 defines a pair of radial passages 276 each of which extend between injection fitting 274 and a pair of axial passages 278. Axial passages 278 are open to the moving chambers on opposite sides of one non-orbiting scroll member 100 of compression system 210 to inject the vapor into these moving chambers as required by a control system as is well known in the art.

Figure 10:
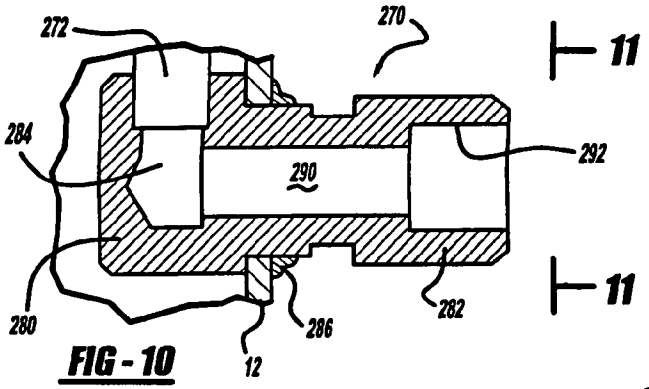
FIG. 10 is an enlarged cross-sectional view of the vapor injection fitting shown in FIG. 4.
Figure 11:
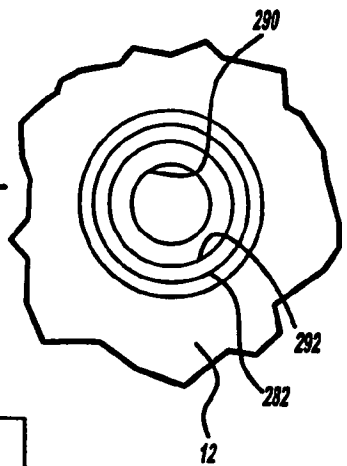
FIG. 11 is an end view of the fitting shown in FIG. 10.

Referring now to FIGS. 10 and 11, vapor injection fitting 270 is shown in greater detail. Vapor Injection fitting 270 comprises an internal portion 280, and an external portion 282. Internal portion 280 includes an L-shaped passage 284 which sealingly receives injection tube 272 at one end. External portion 282 extends from the outside of shell assembly 12 to the inside of shell assembly 12 where it is unitary or integral with internal portion 280. A welding or brazing attachment 286 secures and seals vapor injection fitting 270 to shell assembly 12. External portion 282 defines a bore 290 which is an extension of L-shaped passage 284. External portion 282 also defines a cylindrical bore 292 to which the tubing of the refrigeration system is secured.

Figure 12:
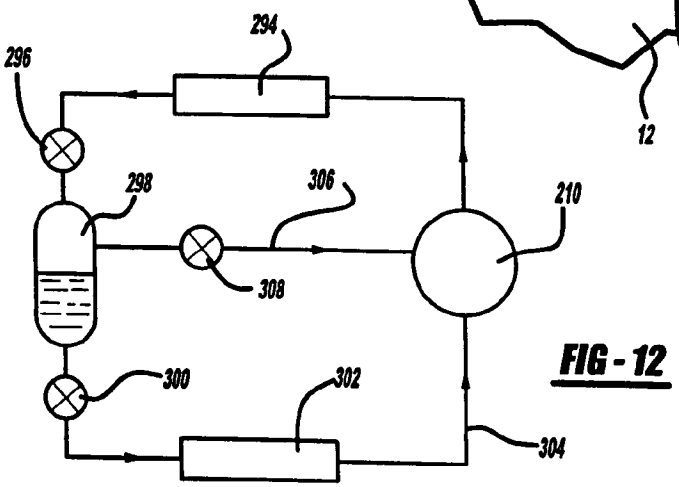
FIG. 12 is a schematic diagram of a refrigerant system utilizing the capacity control system and the vapor injection system in accordance with the present invention.

FIG. 12 illustrates vapor injection system 214 which provides the vapor for the vapor injection system of compression system 210. Compression system 210 is shown in a refrigeration system which includes a condenser 294, a first expansion valve or throttle 296, a flash tank or an economizer 298, a second expansion valve or throttle 300, an evaporator 302 and a series of piping 304 interconnecting the components as shown in FIG. 12. Compression system 210 is operated by the motor to compress the refrigerant gas. The compressed gas is then liquified by condenser 294. The liquified refrigerant passes through expansion valve 296 and expands in flash tank 298 where it is separated into gas and liquid. The gaseous refrigerant further passes through piping 306 to be introduced into compression system 210 through vapor injection fitting 270. On the other hand, the remaining liquid refrigerant further expands in expansion valve 300, is then vaporized in evaporator 302 and is again taken into compression system 210.

The incorporation of flash tank 298 and the remainder of vapor injection system 214, allows the capacity of one set of scrolls 86 and 100 of compression system 210 to increase above the fixed capacity of one set of scrolls 86 and 100 of compression system 210. Typically, at standard air conditioning conditions, the capacity of one of the compressors can be increased by approximately 20% to provide one set of the scrolls with 120% of its capacity which is 110% of the capacity of compression system 210. In order to be able to control the capacity of one set of scrolls 86 and 100 of compression system 210, a solenoid valve 308 is positioned within piping 306. The amount of percent increase in the capacity of one set of scrolls 86 and 100 of compression system 210 can be controlled by operating solenoid valve 308 in a pulse width modulation mode. Solenoid valve 308 when operated in a pulse width modulation mode in combination with capacity control system 212 of compression system 210 allows the capacity of compression system 210 to be positioned anywhere between 50% and 110%.

Figure 13:
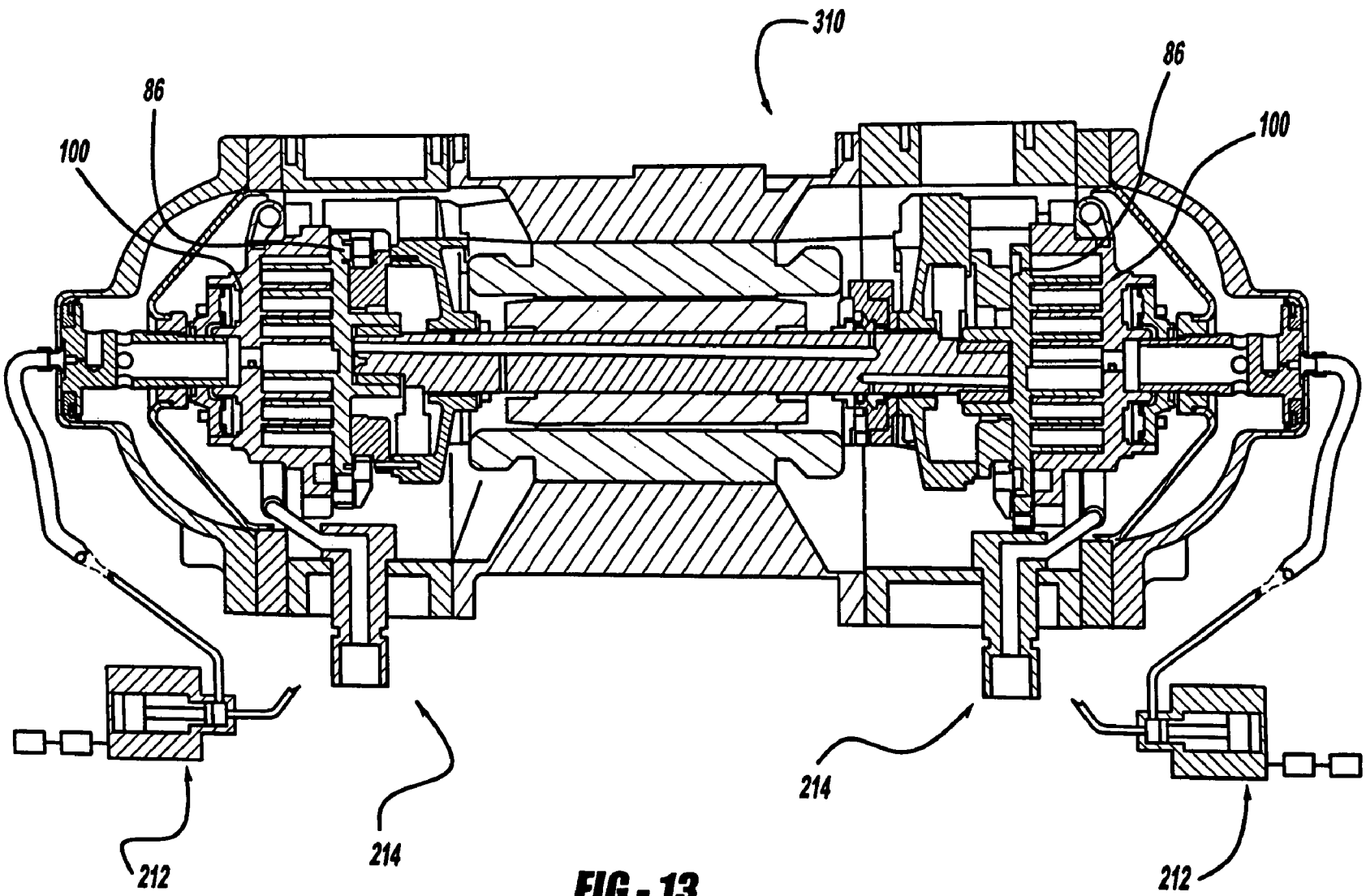
FIG. 13 is a vertical cross-sectional view of the motor compressor system shown in FIG. 3 with both of the compressors incorporating a pulse width modulation capacity control system and a vapor injection system in accordance with the present invention.

Referring now to FIG. 13, there is shown a compression system which includes a unique capacity control system and a vapor injection system in accordance with another embodiment of the present invention and which is designated generally by the reference numeral 310. Compression system 310 is the same as compression system 210, except that both pairs of scrolls 86 and 100 incorporate both capacity control system 212 and vapor injection system 214. By incorporating capacity control system 212 and vapor injection system 214 into both pairs of scrolls 86 and 100, the capacity of compression system 310 can be varied from 0% to 120%.

Figure 14:
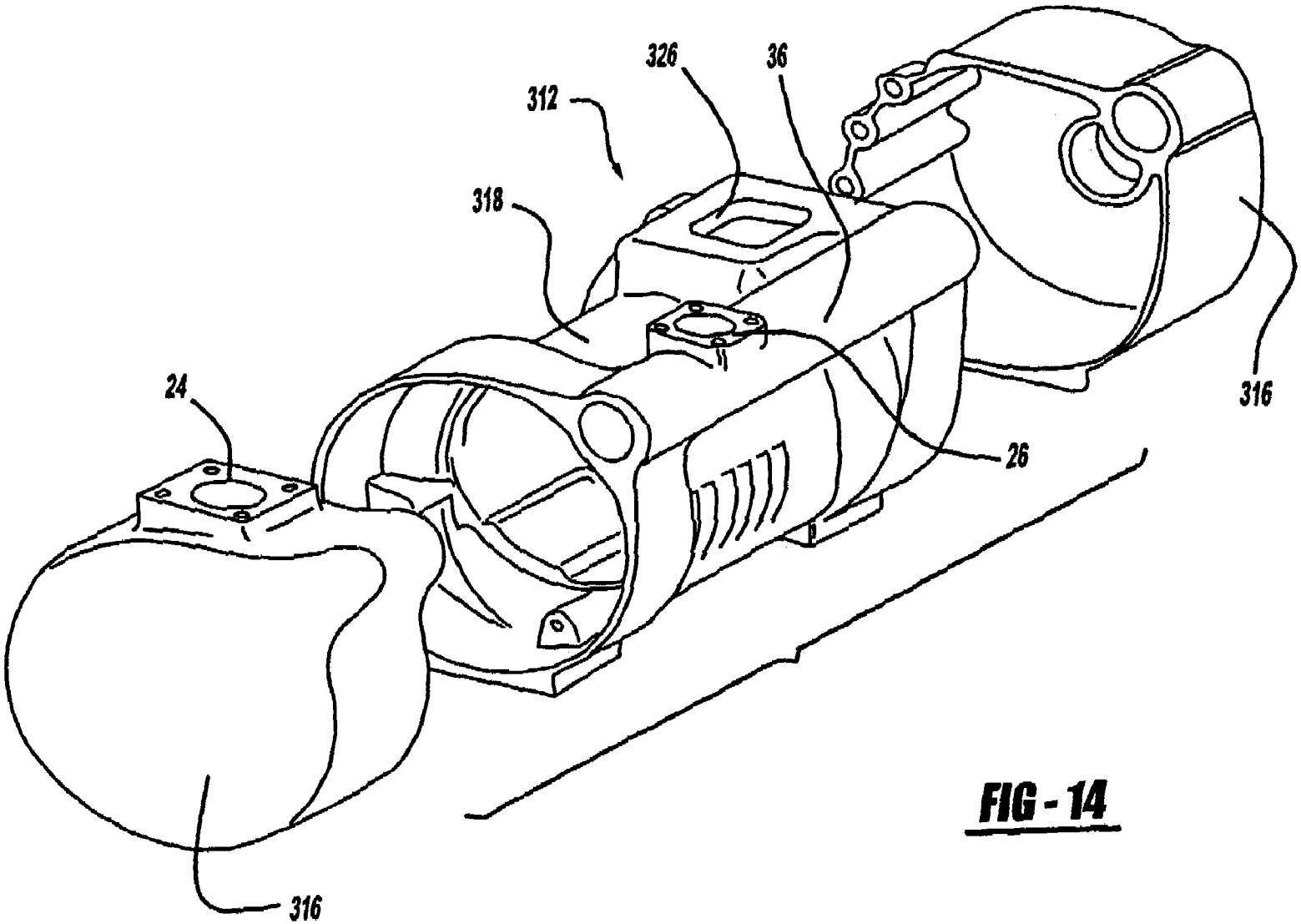
FIG. 14 is an exploded perspective view of a shell assembly in accordance with another embodiment of the present invention.
Figure 15:
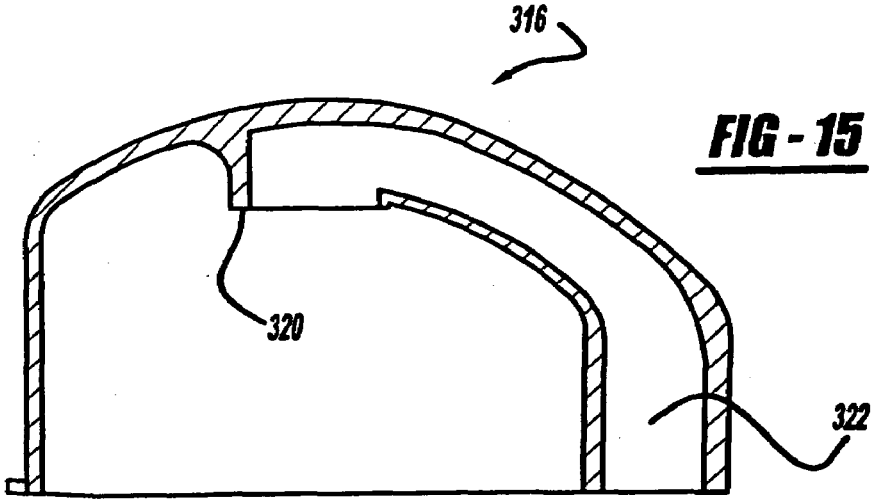
FIG. 15 is a sectional view of the end cap illustrated in FIG. 14.

Referring now to FIGS. 14 and 15, shell assembly 312 in accordance with the present invention is illustrated. Shell assembly 312 comprises a pair of end caps 316 and a central shell 318. Each end cap 316 is a single-piece integrated structure which includes intermediate shell 20, end cap 16 and an extension of conduit 36 and which eliminates the need for partition plate assembly 14. The integration of these components reduces both complexity and cost. End cap 316 defines a surface 320 for engagement with floating seal assembly 114 and a discharge passage 322 which communicates with conduit 36 defined by central shell 318. Similar to FIG. 2, a discharge valve can be located anywhere within conduit 36, including the extension of conduit 36 defined by end cap 316, if desired.

Central shell 318 defines discharge fitting 26 and conduit 36 which is separated from the main body of central shell 318. In addition, central shell 318 defines an electrical connection access 326 for providing both power and diagnostics to the motor positioned within central shell 318. One end cap 316 defines suction inlet fitting 24, thus eliminating the need for conduit 38.

The motor and compressors that are positioned within shell assembly 12 illustrated in FIG. 2 are designed to be assembled into shell assembly 312. The description of the motor and compressors detailed above for FIG. 2 thus apply to shell assembly 312 also.

End cap 316 can be adapted to include capacity control system 212 in a manner similar to that illustrated in FIG. 4. In a similar manner to end cap 16, shell fitting 220 can be integral with end cap 316, or it can be a separate component attached to end cap 316.

In addition, central shell 318 can be adapted to incorporate vapor injection system 214 detailed above. Thus, the description of capacity control system 212 and vapor injection system 214 detailed above for FIGS. 4–12 apply to a shell assembly which incorporates end cap 316. Furthermore, it is within the scope of the present invention to incorporate end cap 316 on both ends of central shell 318 and to provide capacity control system 212 and vapor injection system 214 to both compressors similar to that described above for FIG. 13. Thus, the description of capacity control systems 212 and vapor injection systems 214 detailed above for FIG. 13 apply to a shell assembly which incorporates two end caps 316.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A scroll machine comprising:

an outer shell;

a first scroll compressor disposed within said outer shell;

a second scroll compressor disposed within said outer shell;

a drive shaft extending between said first and second scroll compressors, said drive shaft having a first drive flat at a first end engaging said first scroll compressor and a second drive flat at a second end engaging said second scroll compressor, said first and second drive flats being out of rotational phase with one another by 180°; and a motor disposed within said outer shell between said first and second scroll compressors, said motor being drivingly coupled to said drive shaft for rotatably driving said drive shaft.

2. The scroll machine in accordance with claim 1, wherein said motor comprises:

a stator attached to said outer shell; and a rotor attached to said drive shaft.

3. The scroll machine in accordance with claim 1, wherein said first scroll compressor comprises:

a first scroll member having a first spiral wrap projecting outwardly from a first end plate;

a second scroll member having a second spiral wrap projecting outwardly from a second end plate, said second spiral wrap being interleaved with said first spiral wrap to define a first plurality of moving chambers therebetween when said second scroll member orbits with respect to said first scroll member; and a first main bearing housing attached to said outer shell, said first main bearing housing rotatably supporting said drive shaft.

4. The scroll machine in accordance with claim 3, wherein said second scroll compressor comprises:

a third scroll member having a third spiral wrap projecting outwardly from a third end plate;

a fourth scroll member having a fourth spiral wrap projecting outwardly from a fourth end plate, said fourth spiral wrap being interleaved with said third spiral wrap to define a second plurality of moving chambers therebetween when said fourth scroll member orbits with respect to said third scroll member; and a second main bearing housing attached to said outer shell, said second main bearing housing rotatably supporting said drive shaft.

5. The scroll machine in accordance with claim 1, wherein said outer shell defines a suction pressure chamber in communication with said first and second scroll compressors, a first discharge pressure chamber in communication with said first scroll compressor and a second discharge chamber in communication with said second scroll compressor.

6. The scroll machine in accordance with claim 5, wherein said first and second scroll compressors are disposed within said suction pressure chamber.

7. The scroll machine in accordance with claim 1, further comprising a first capacity modulation system for varying the capacity of said first scroll compressor.

8. The scroll machine in accordance with claim 7, wherein said first capacity modulation system includes a pulse width modulation system.

9. The scroll machine in accordance with claim 8, further comprising a second capacity modulation system for varying the capacity of said second scroll compressor.

10. The scroll machine in accordance with claim 9, wherein said first capacity modulation system includes a first pulse width modulation system and said second capacity modulation system includes a second pulse width modulation system.

11. The scroll machine in accordance with claim 1, wherein said motor is a variable speed motor.

12. A scroll machine comprising:

an outer shell defining a central shell and a discharge duct having a discharge port, said discharge duct being spaced from said central shell;

a first scroll compressor disposed within said outer shell, said first scroll compressor providing compressed fluid to a first discharge chamber in communication with said discharge duct;

a second scroll compressor disposed within said outer shell, said second scroll compressor providing compressed fluid to a second discharge chamber in communication with said discharge duct;

a drive shaft extending between and couple to each of said first and second scroll compressors; and a motor disposed within said outer shell between said first and second scroll compressors, said motor being drivingly coupled to said drive shaft.

13. The scroll machine according to claim 12 wherein said outer shell defines a suction duct having a suction duct port, said suction duct being spaced from said central shell.

14. The scroll machine according to claim 12 wherein said drive shaft has a first drive flat at a first end engaging said first scroll compressor and a second drive flat at a second end engaging said second scroll compressor, said first and second drive flats being out of rotational phase with one another by 180°.

15. The scroll machine in accordance with claim 12, wherein said motor comprises:

a stator attached to said outer shell; and a rotor attached to said drive shaft.

16. The scroll machine in accordance with claim 12, wherein said first scroll compressor comprises:

a first scroll member having a first spiral wrap projecting outwardly from a first end plate;

a second scroll member having a second spiral wrap projecting outwardly from a second end plate, said second spiral wrap being interleaved with said first spiral wrap to define a first plurality of moving chambers therebetween when said second scroll member orbits with respect to said first scroll member; and a first main bearing housing attached to said outer shell, said first main bearing housing rotatably supporting said drive shaft.

17. The scroll machine in accordance with claim 16, wherein said second scroll compressor comprises:

a third scroll member having a third spiral wrap projecting outwardly from a third end plate;

a fourth scroll member having a fourth spiral wrap projecting outwardly from a fourth end plate, said fourth spiral wrap being interleaved with said third spiral wrap to define a second plurality of moving chambers therebetween when said fourth scroll member orbits with respect to said third scroll member; and a second main bearing housing attached to said outer shell, said second main bearing housing rotatably supporting said drive shaft.

18. The scroll machine in accordance with claim 12, wherein said outer shell defines a suction pressure chamber in communication with said first and second scroll compressors, a first discharge pressure chamber in communication with said first scroll compressor and a second discharge chamber in communication with said second scroll compressor.

19. The scroll machine in accordance with claim 18, wherein said first and second scroll compressors are disposed within said suction pressure chamber.

20. The scroll machine in accordance with claim 12, further comprising a first capacity modulation system for varying the capacity of said first scroll compressor.

21. The scroll machine in accordance with claim 20, wherein said first capacity modulation system includes a pulse width modulation system.

22. The scroll machine in accordance with claim 20, further comprising a second capacity modulation system for varying the capacity of said second scroll compressor.

23. The scroll machine in accordance with claim 22, wherein said first capacity modulation system includes a first pulse width modulation system and said second capacity modulation system includes a second pulse width modulation system.

24. The scroll machine in accordance with claim 12, wherein said motor is a variable speed motor.

25. A scroll machine comprising:

an outer shell forming a central shell and a suction duct having a suction port, said suction duct being spaced from said central shell;

a first scroll compressor disposed within said outer shell, said first scroll compressor providing compressed fluid to a first discharge chamber, said first scroll compressor being in communication with said suction duct;

a second scroll compressor disposed within said outer shell, said second scroll compressor providing compressed fluid to a second discharge chamber, said second scroll compressor being in communication with said suction duct;

a drive shaft extending between and coupled to each of said first and second scroll compressors; and a motor disposed within said central shell between said first and second scroll compressors, said motor being drivingly coupled to said drive shaft.

26. The scroll machine in accordance with claim 25, wherein said motor comprises:

a stator attached to said outer shell; and a rotor attached to said drive shaft.

27. The scroll machine in accordance with claim 25, wherein said first scroll compressor comprises:

a first scroll member having a first spiral wrap projecting outwardly from a first end plate;

a second scroll member having a second spiral wrap projecting outwardly from a second end plate, said second spiral wrap being interleaved with said first spiral wrap to define a first plurality of moving chambers therebetween when said second scroll member orbits with respect to said first scroll member; and a first main bearing housing attached to said outer shell, said first main bearing housing rotatably supporting said drive shaft.

28. The scroll machine in accordance with claim 27, wherein said second scroll compressor comprises:

a third scroll member having a third spiral wrap projecting outwardly from a third end plate;

a fourth scroll member having a fourth spiral wrap projecting outwardly from a fourth end plate, said fourth spiral wrap being interleaved with said third spiral wrap to define a second plurality of moving chambers therebetween when said fourth scroll member orbits with respect to said third scroll member; and a second main bearing housing attached to said outer shell, said second main bearing housing rotatably supporting said drive shaft.

29. The scroll machine in accordance with claim 25, wherein said outer shell defines a suction pressure chamber in communication with said first and second scroll compressors, a first discharge pressure chamber in communication with said first scroll compressor and a second discharge chamber in communication with said second scroll compressor.

30. The scroll machine in accordance with claim 29, wherein said first and second scroll compressors are disposed within said suction pressure chamber.

31. The scroll machine in accordance with claim 25, further comprising a first capacity modulation system for varying the capacity of said first scroll compressor.

32. The scroll machine in accordance with claim 31, wherein said first capacity modulation system includes a pulse width modulation system.

33. The scroll machine in accordance with claim 31, further comprising a second capacity modulation system for varying the capacity of said second scroll compressor.

34. The scroll machine in accordance with claim 33, wherein said first capacity modulation system includes a first pulse width modulation system and said second capacity modulation system includes a second pulse width modulation system.

35. The scroll machine in accordance with claim 25, wherein said motor is a variable speed motor.

36. A scroll machine comprising:

an outer shell;

a first scroll compressor disposed within said outer shell;

a second scroll compressor disposed within said outer shell;

a drive shaft extending between and coupled to each of said first and second scroll compressors;

an oil pump driven by said drive shaft, said oil pump providing lubricating oil to said first and second scroll compressors through a passage defined by said drive shaft;

a motor disposed within said outer shell between said first and second scroll compressors, said motor being drivingly coupled to said drive shaft.

37. The scroll machine according to claim 36 wherein said outer shell defines a suction duct having a suction port, said suction duct being spaced from said outer shell.

38. The scroll machine according to claim 36 wherein said drive shaft has a first drive flat at a first end engaging said first scroll compressor and a second drive flat at a second end engaging said second scroll compressor, said first and second drive flats being out of rotational phase with one another by 180°.

39. The scroll machine in accordance with claim 36, wherein said motor comprises:

a stator attached to said outer shell; and a rotor attached to said drive shaft.

40. The scroll machine in accordance with claim 36, wherein said first scroll compressor comprises:

a first scroll member having a first spiral wrap projecting outwardly from a first end plate;

a second scroll member having a second spiral wrap projecting outwardly from a second end plate, said second spiral wrap being interleaved with said first spiral wrap to define a first plurality of moving chambers therebetween when said second scroll member orbits with respect to said first scroll member; and a first main bearing housing attached to said outer shell, said first main bearing housing rotatably supporting said drive shaft.

41. The scroll machine in accordance with claim 40 wherein said second scroll compressor comprises:

a third scroll member having a third spiral wrap projecting outwardly from a third end plate;

a fourth scroll member having a fourth spiral wrap projecting outwardly from a fourth end plate, said fourth spiral wrap being interleaved with said third spiral wrap to define a second plurality of moving chambers therebetween when said fourth scroll member orbits with respect to said third scroll member; and a second main bearing housing attached to said outer shell, said second main bearing housing rotatably supporting said drive shaft.

42. The scroll machine in accordance with claim 36, wherein said outer shell defines a suction pressure chamber in communication with said first and second scroll compressors, a first discharge pressure chamber in communication with said first scroll compressor and a second discharge chamber in communication with said second scroll compressor.

43. The scroll machine in accordance with claim 42, wherein said first and second scroll compressors are disposed within said suction pressure chamber.

44. The scroll machine in accordance with claim 36, further comprising a first capacity modulation system for varying the capacity of said first scroll compressor.

45. The scroll machine in accordance with claim 44, wherein said first capacity modulation system includes a pulse width modulation system.

46. The scroll machine in accordance with claim 44, further comprising a second capacity modulation system for varying the capacity of said second scroll compressor.

47. The scroll machine in accordance with claim 46, wherein said first capacity modulation system includes a first pulse width modulation system and said second capacity modulation system includes a second pulse width modulation system.

48. The scroll machine in accordance with claim 36, wherein said motor is a variable speed motor.

49. A scroll machine comprising:

an outer shell defining a central shell, defining a suction chamber and a discharge duct having a discharge port, said discharge duct being spaced from said central shell;

a first end cap attached to a first end of said central shell, said first end cap defining a first discharge passage in communication with said discharge duct, said first end cap defining said suction chamber;

a second cap attached to a second end of said central shell, said second end cap defining a second discharge passage in communication with said discharge duct, said second end cap defining said suction chamber;

a first scroll compressor disposed within said outer shell;

a second scroll compressor disposed within said outer shell;

a drive shaft extending between and coupled to each of said first and second scroll compressors; and a motor disposed within said outer shell between said first and second scroll compressions, said motor being drivingly coupled to said drive shaft.

50. The scroll machine according to claim 49 wherein said drive shaft has a first drive flat at a first end engaging said first scroll compressor and a second drive flat at a second end engaging said second scroll compressor, said first and second drive flats being out of rotational phase with one another by 180°.

51. The scroll machine in accordance with claim 49, wherein said motor comprises:

a stator attached to said outer shell; and a rotor attached to said drive shaft.

52. The scroll machine in accordance with claim 49, wherein said first scroll compressor comprises:

a first scroll member having a first spiral wrap projecting outwardly from a first end plate;

a second scroll member having a second spiral wrap projecting outwardly from a second end plate, said second spiral wrap being interleaved with said first spiral wrap to define a first plurality of moving chambers therebetween when said second scroll member orbits with respect to said first scroll member; and a first main bearing housing attached to said outer shell, said first main bearing housing rotatably supporting said drive shaft.

53. The scroll machine in accordance with claim 52, wherein said second scroll compressor comprises:

a third scroll member having a third spiral wrap projecting outwardly from a third end plate;

a fourth scroll member having a fourth spiral wrap projecting outwardly from a fourth end plate, said fourth spiral wrap being interleaved with said third spiral wrap to define a second plurality of moving chambers therebetween when said fourth scroll member orbits with respect to said third scroll member; and a second main bearing housing attached to said outer shell, said second main bearing housing rotatably supporting said drive shaft.

54. The scroll machine in accordance with claim 49, further comprising a first capacity modulation system for varying the capacity of said first scroll compressor.

55. The scroll machine in accordance with claim 54, wherein said first capacity modulation system includes a pulse width modulation system.

56. The scroll machine in accordance with claim 54, further comprising a second capacity modulation system for varying the capacity of said second scroll compressor.

57. The scroll machine in accordance with claim 56, wherein said first capacity modulation system includes a first pulse width modulation system and said second capacity modulation system includes a second pulse width modulation system.

58. The scroll machine in accordance with claim 49, wherein said motor is a variable speed motor.

* * * * *